United States Patent [19]

Huggins

[11] Patent Number: 5,016,855

[45] Date of Patent: May 21, 1991

[54] BEAM CLAMP SYSTEM

[76] Inventor: Morris Huggins, 5479 Sunrise Blvd., Delray Beach, Fla. 33445

[21] Appl. No.: 439,632

[22] Filed: Nov. 20, 1989

Related U.S. Application Data

[63] Continuation-in-part of Ser. No. 845,598, Mar. 28, 1986.

[51] Int. Cl.[5] ..... E04G 13/04

[52] U.S. Cl. ..... 249/21; 249/20; 249/33; 249/50; 249/208; 249/219.1; 425/63

[58] Field of Search ..... 249/5, 19, 20, 21, 28, 249/29, 30, 33, 34, 48, 50, 163, 208, 210, 216, 219.1; 425/63, 65; 264/33, 34

[56] References Cited

U.S. PATENT DOCUMENTS

| | | | |
|---|---|---|---|
| 1,140,776 | 5/1915 | Teters | 249/5 |
| 1,575,959 | 3/1926 | Barstad | 249/33 |
| 1,636,396 | 7/1927 | Urschel | 249/219.1 |
| 2,400,852 | 5/1946 | Stevenson | 249/21 |
| 2,513,882 | 7/1950 | Magdiel et al. | 249/20 |
| 2,895,208 | 7/1959 | Paxton | 249/21 |
| 3,479,000 | 11/1969 | Powell | 249/219.1 |
| 4,029,288 | 6/1977 | Murphy et al. | 249/216 |
| 4,106,746 | 8/1978 | Baculo | 249/216 |
| 4,339,106 | 7/1982 | Navarro | 249/219.1 |
| 4,494,725 | 1/1985 | Sims | 249/5 |

FOREIGN PATENT DOCUMENTS

| | | | |
|---|---|---|---|
| 613056 | 6/1978 | U.S.S.R. | 249/33 |
| 150476 | 9/1920 | United Kingdom | 249/219.1 |
| 174451 | 1/1922 | United Kingdom | 249/219.1 |
| 175128 | 2/1922 | United Kingdom | 249/219.1 |

*Primary Examiner*—James C. Housel

*Attorney, Agent, or Firm*—Malin, Haley, McHale, DigMaggio & Crosby

[57] ABSTRACT

A beam clamp system for securely engaging a pair of concrete form panels for maintaining them in generally vertical position against inadvertent dislodgment or dislodgment due to outward pressure from recently poured liquid concrete. Each clamp has a horizontal portion and two long vertical members, brackets to slidably engage concrete form panels, and rods to securely and adjustably hold these form panels in place while concrete is poured and is curing. The form panels include a frame and a sheet with at least one smooth synthetic surface. In addition, this system includes a scaffolding system built into the beam clamp system. The system also includes a hanger system for supporting and positioning "re-bar" between the concrete form panels while liquid concrete is being poured and while it cures. Also a shepherd crook-shaped truss strap is part of the system and attaches to the "re-bar" hangers and the re-bar.

21 Claims, 6 Drawing Sheets

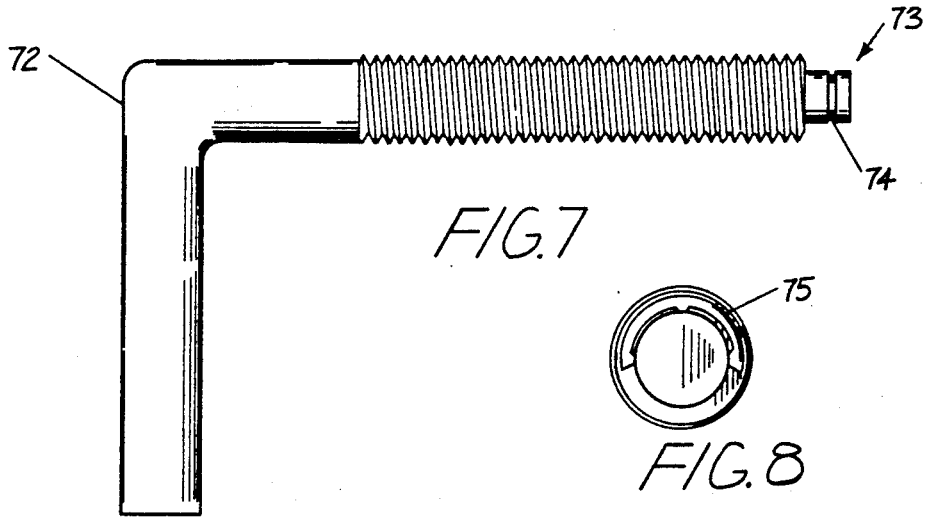
FIG. 7
FIG. 8
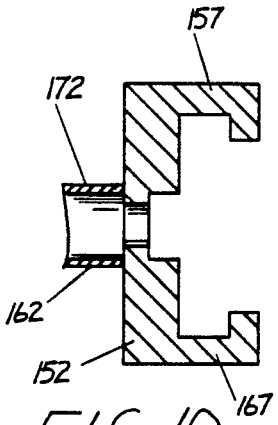
FIG. 10
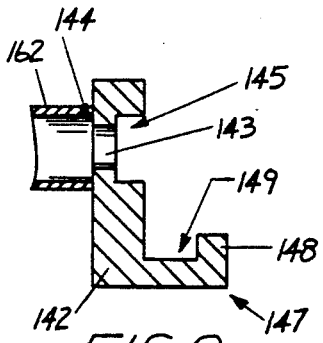
FIG. 9
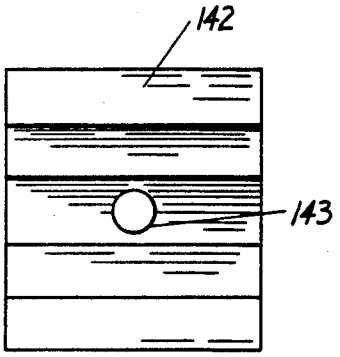
FIG. 11
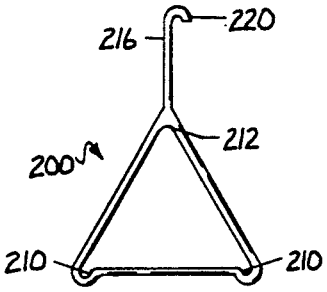
FIG. 12
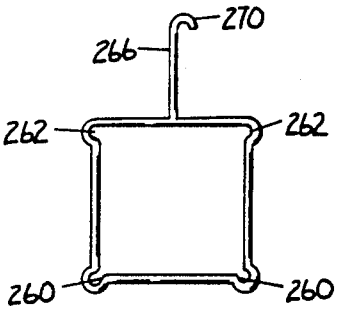
FIG 13
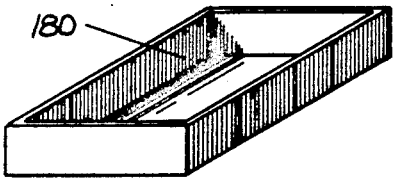
FIG. 16
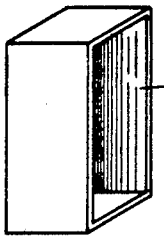
FIG. 17

BEAM CLAMP SYSTEM

This application is a continuation-in-part of application Ser. No. 845,598, filed Mar. 28, 1986.

BACKGROUND OF THE INVENTION

1. Field of the Invention

This invention relates to a method and apparatus for molding a concrete beam or a concrete header on an existing block wall, for use in home, store, and wall construction.

2. Description of the Prior Art

U.S. Pat. No. 1,575,959, BARSTAD, discloses a substantially inverted "U"-shaped clamp apparatus having a transverse member, two elongated legs attached to the bottom of the transverse member, and a rod assembly through the elongated legs to engage a pair of essentially parallel, spaced forms. BARSTAD does not teach a means to receive the top end of the forms, confine them, and provide a pivoting point around which these forms can be slightly rotated so as to form a pronounced clamping action at the bottom of these forms.

In addition, BARSTAD teaches horizontal strips attached to the outside of the forms. However, no mention is made of combining horizontal, vertical, and stud pieces rigidly to form a solid frame to which can be attached a sheet.

U.S. Pat. No. 4,029,288, MURPHY, also discloses a substantially inverted "U"-shaped clamp apparatus, but also has a wedge-shaped flange extending downward from the transverse member. The spacing between the flange, as well as the tapering of the flange cooperate with the elongated legs of inverted "U" part of the apparatus to allow a form member to be wedged between the leg members and the flange. While MURPHY teaches a confining of the top edge of the forms by wedging them between the flanges and the leg members, it does not mention a flange or other form containing piece that allows pivoting of the form around the flange or containing piece.

British Pat. No. 175,128 teaches recesses in forms, for receiving the free end of a rod directed through the legs of the clamp and into the recesses in the forms. The recesses provide a point of transfer of the forces between the rods and the forms. But, there is no mention of means by which the forms can be drawn away from the "cured" concrete. In particular, there is no mention of means whereby the forms can be adjustably positioned before the concrete is poured and then by the same means, aid in removing the forms from the concrete.

SUMMARY AND OBJECTS OF THE INVENTION

The present invention provides a method and apparatus for securely engaging a plurality of beam clamps with pairs of concrete form panels for maintaining them in generally vertical position against inadvertent dislodgment before pouring of concrete or dislodgment due to outward hydraulic pressure from the liquid concrete after it is poured and before it hardens. The form panels each include a frame and a sheet presenting at least one smooth surface. Structurally, each clamp has a horizontal portion and two long vertical members generally forming a "pi" shape.

In addition, each clamp has slidably engagable, adjustable means to easily engage and position the form panels as well as assisting in the separation of the form panels from the hardened concrete.

An improvement of this invention over the prior art is the clamping assembly that connects the forms to the clamp. The improvement consists of a system of brackets and tracks that slidably engages and connects the forms to the rods that are part of the clamp. This sliding connection provides an easy way to connect the forms to the clamp as well as allowing for precise positioning of the forms along the sliding axis of the connection.

Another improvement of this invention relating to the clamping assembly mentioned above is that the same assembly that securely positions the forms while the liquid concrete is poured, also aids in pulling the form away from the concrete after it is hardened. This improvement aids the user of this system in separating the form from the concrete and helps preserve the form from damage to the form by hitting it with hammers to separate it from the concrete. This is done by providing a separation force directed to the entire form by the pull on the frame of the form by the clamping assembly.

Yet another improvement of this invention is the reusable nature of the forms. In the existing art, forms are typically made of plywood pieces. Because of such things as nailing into the plywood pieces to secure them to means to position them, and the need to strike the plywood with hammers to remove it from the hardened concrete, the plywood pieces have a very short lifetime, often not being in a condition after a first use to be reusable. The present invention provides for inexpensive reusable forms, thus cutting the costs to make headers and concrete beams. In addition, because of the simplistic design of the forms, large forms built for odd-sized jobs can be "cut-down" to a conventional size with a minimum of effort or waste, and thereby reused on other jobs.

Further, the clamp system is adapted to provide a "built-in" scaffold on top of the clamp system to provide a safe and secure place for workers to stand while pouring concrete between the forms. Currently available apparatuses for forming headers to existing walls or concrete beams do not provide safe places for the workers who are pouring the liquid concrete into the apparatus to stand. Typically, these workers stand on the narrow tops of the forms while pouring the liquid concrete. The narrowness of this standing platform is made more unsecure by the slippery nature of the liquid concrete that occasionally spills onto the tops of the forms. In addition, headers, by definition, are formed on the tops of walls. Because the tops of walls are typically up in the air, sometimes many stories up, the danger from slipping off of the tops of the forms, and falling is substantial. The danger from falling while making concrete beams is also significant.

The invention also includes "hangers" that support and position "re-bar" in a predetermined position in the space between the forms while the liquid concrete is being poured.

Also included in the invention is a shepherd crook-shaped truss strap that wraps around the "re-bar" supported and positioned by the hangers and which is secured to the "re-bar" and hanger by twist ties.

The invention as described herein is an improvement over existing highly sophisticated clamps which include relatively movable and adjustable members. The beam clamp of this invention is comparatively simple in construction and use thereby permitting use of unskilled labor in the utilization thereof, yet achieving the results desired. Cost of manufacture of the beam clamp of the invention is relatively lower than of the complex clamps of the prior art. Due to the simplicity of design and adjustment, time of assembly of the beam clamp of the invention is minimal in comparison to the time expended in set-up of the clamps of the prior art.

It is therefore a object of this invention to provide an improvement in the method and apparatus for molding a concrete header on an existing block wall or for making concrete beams.

It is a further object of this invention to provide a relatively non-complex and inexpensive method and apparatus for bracing and supporting form panels to support concrete poured to form a header or concrete beam.

It is still another object of the invention to provide a method and apparatus for use with non-complex form panels thereby facilitating quick set-up and knock-down thereof.

It is yet still another object of the invention to provide a method and apparatus which obviates fastening the form panels to an existing wall thereby resulting in savings of time, labor and costs.

It is another object of the invention to provide a method and apparatus for adjustably connecting a form panel to a beam clamp.

It is another object of the invention to provide inexpensive, reusable forms.

It is another object of the invention to provide a method and apparatus that assists in the separation of the forms from the hardened concrete.

It is yet another object of the invention to provide a combination scaffold and apparatus for molding a concrete header on an existing wall or concrete beam that is simple to set up and use.

It is yet another object of the invention to provide a hanger to support and position "re-bar" between the forms while concrete is being poured and while it hardens.

It is yet another object of the invention to provide a truss strap that easily attaches to the "re-bar" supported and positioned in the hangers and to the hangers themselves.

Still other objects of the invention will be readily apparent to those skilled in the art in light of the following detailed description of the invention.

BRIEF DESCRIPTION OF THE DRAWING

FIG. 7 shows the rod having a circumferentially reduced end with a circumferential groove cut around the circumferentially reduced end.

FIG. 8 is an end view of the circumferentially narrowed end of the rod showing a "C" clip in functional position and attached thereto.

FIG. 9 shows a side view of the bracket used in the top most connecting mechanism shown in FIG. 5.

FIG. 10 shows a side view of the bracket used in the lower connecting mechanism shown in FIG. 6.

FIG. 11 shows a view from the form side of the bracket used in the lower adjusting and connecting means shown in FIG. 5.

FIG. 12 shows a hanger having two cups and one inverted cup.

FIG. 13 shows a hanger having two cups and two inverted cups.

FIG. 16 shows a typical beam pan.

FIG. 17 shows a typical end pan.

DESCRIPTION OF THE INVENTION

Figure 3:
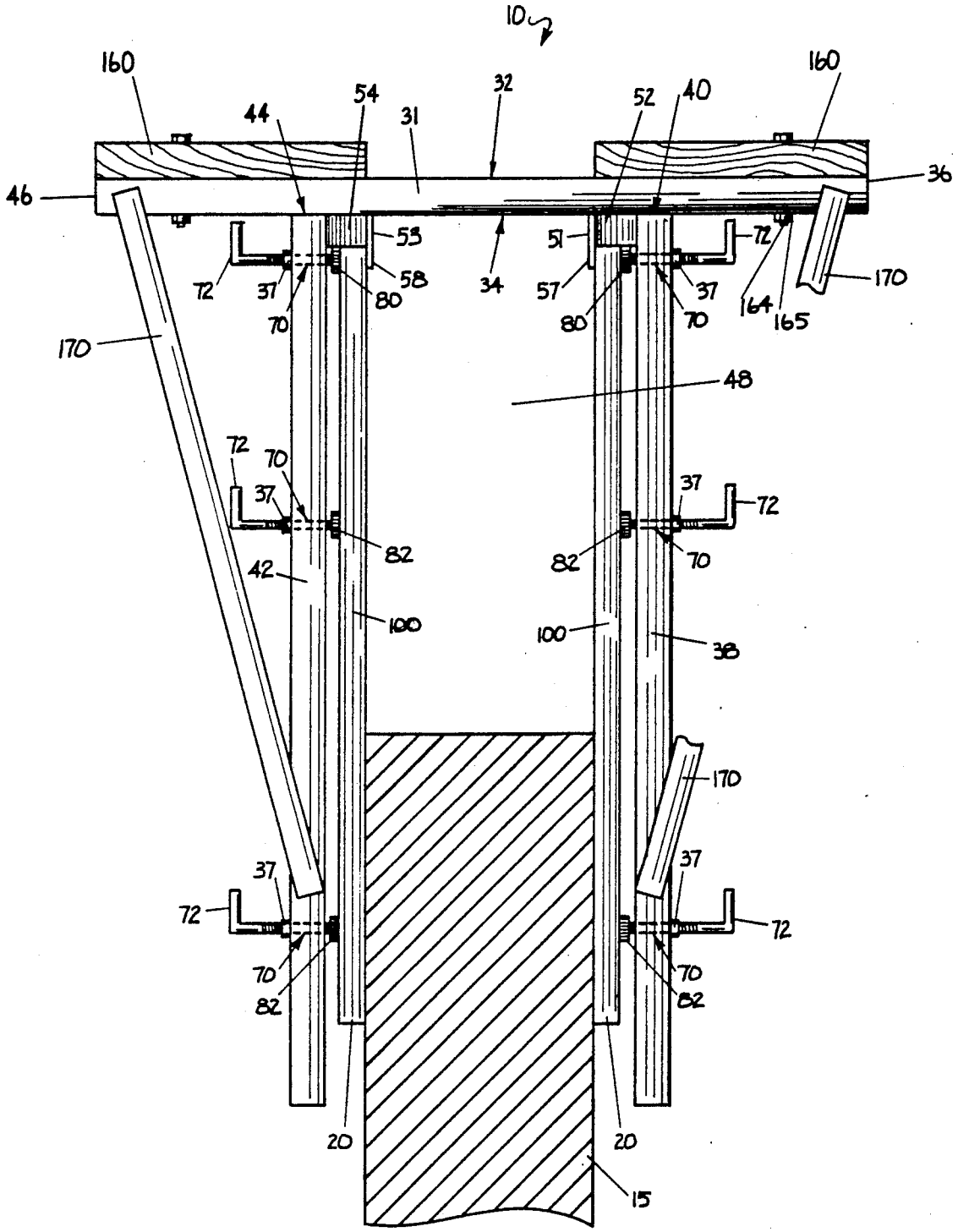
FIG. 3 is an end view of the invention set in place above a cinder or concrete block wall with a beam clamp mounted around and holding in place two form panels on said wall, along with the built-in scaffold.

Referring to the drawing FIG. 3, numeral 10 refers generally to a beam clamp unit constructed in accordance with the invention and is shown mounted on a partially constructed cinder or concrete block wall 15 for securing a pair of form panels 100 thereon for pouring a concrete.

Figure 1:
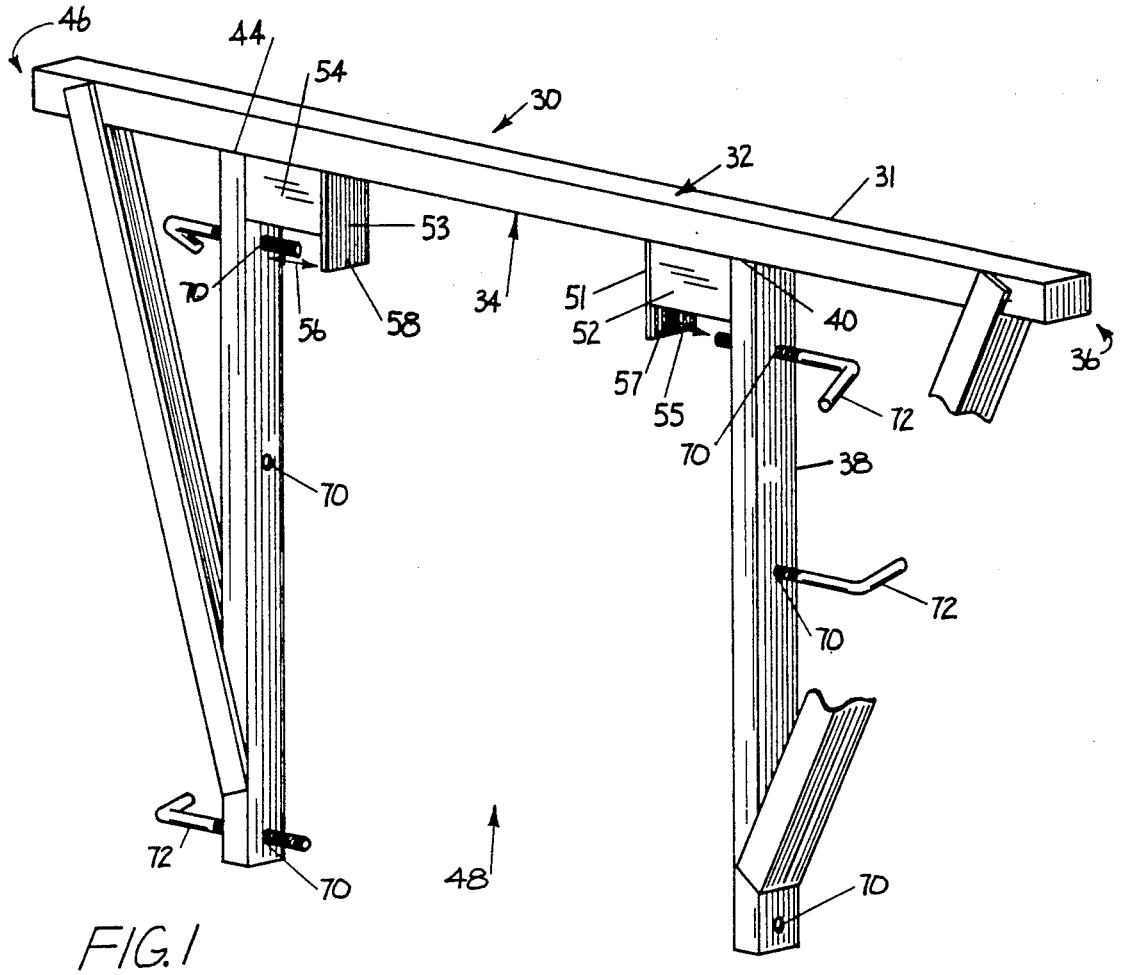
FIG. 1 is a perspective view of a beam clamp of the invention with a cut-away of one of the support arms to show the side of one of the elongated arms.

The beam clamp 30 shown in FIGS. 1 and 3 includes a transverse elongated member 31, having top 32 and bottom 34 surfaces and opposed free ends 36 and 46, being right and left free ends respectively. A first elongated leg member 38 is perpendicular to and secured at 40 to the bottom surface 34 of the transverse member toward the right hand free end thereof by any conventional means such as welding. A second elongated leg 42 is similarly perpendicularly to and secured at 44 to the bottom surface 34 of transverse member toward the left free end 46. The resultant structure is "pi" shaped and includes a free and unobstructed space 48.

Support pieces 52, 54 are abutted to and rigidly secured to the transverse member 31 and the first elongated member 38 and second elongated member 42, respectively, by any conventional means such as welding, so that the support pieces 52, 54 are positioned on the inside of the unobstructed space 48. Attached to the support pieces 52, 54 and to the bottom surface 34 of the transverse member 31, by any conventional means such as welding, are holder pieces 51 and 53, positioned perpendicular to the bottom surface 34 and extending downward beyond the edge of the support pieces 52, 54 so as to form a lip, 57, 58 and corresponding grooves 55 and 56.

The leg members 38, 42 include a plurality of apertures 70, each threadably receiving threaded rods 72 by means of an attached nut 37. The rods 72 ar connected to panel forms 100 by connecting mechanisms 80 and 82 best seen in FIGS. 5 and 6 and described in detail hereafter.

Figure 2:
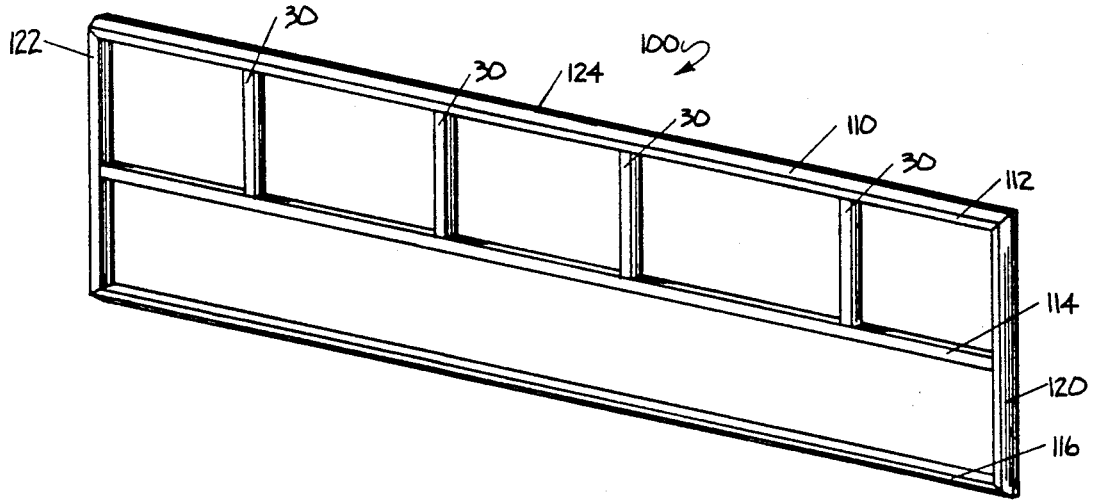
FIG. 2 is a perspective view of one of the form panels used in the invention.

FIG. 2 shows a panel member 100 having a frame 110 including horizontal cross members 112, 114, 116, end members 120, 122 and vertical studs 130 rigidly connected by means such as welding to form a rigid frame. A sheet 124 is secured to the frame by means such as screws. The sheet may be a piece of plywood with a smooth synthetic face on both sides of the plywood. The synthetic face may be formica or other similar surfaces.

Figure 5:
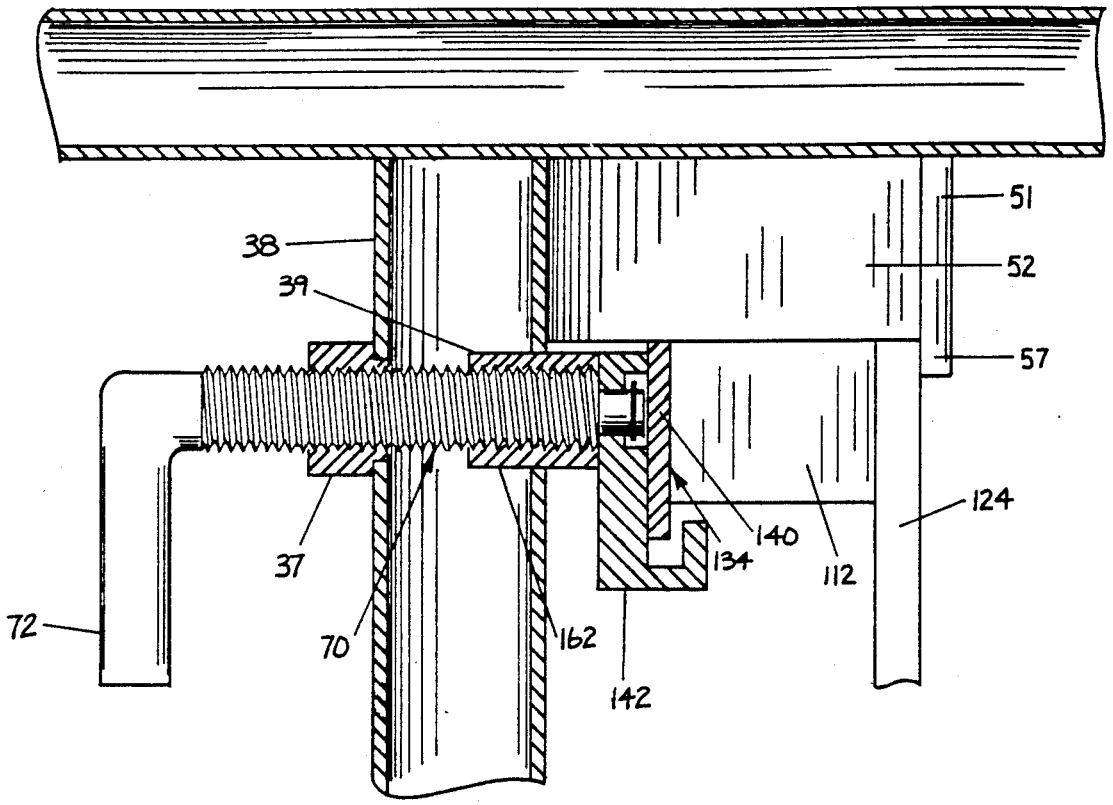
FIG. 5 is a schematic side view illustrating the top most connecting mechanism having adjusting and connecting means for positioning and connecting the forms relative to the beam clamp.
Figure 6:
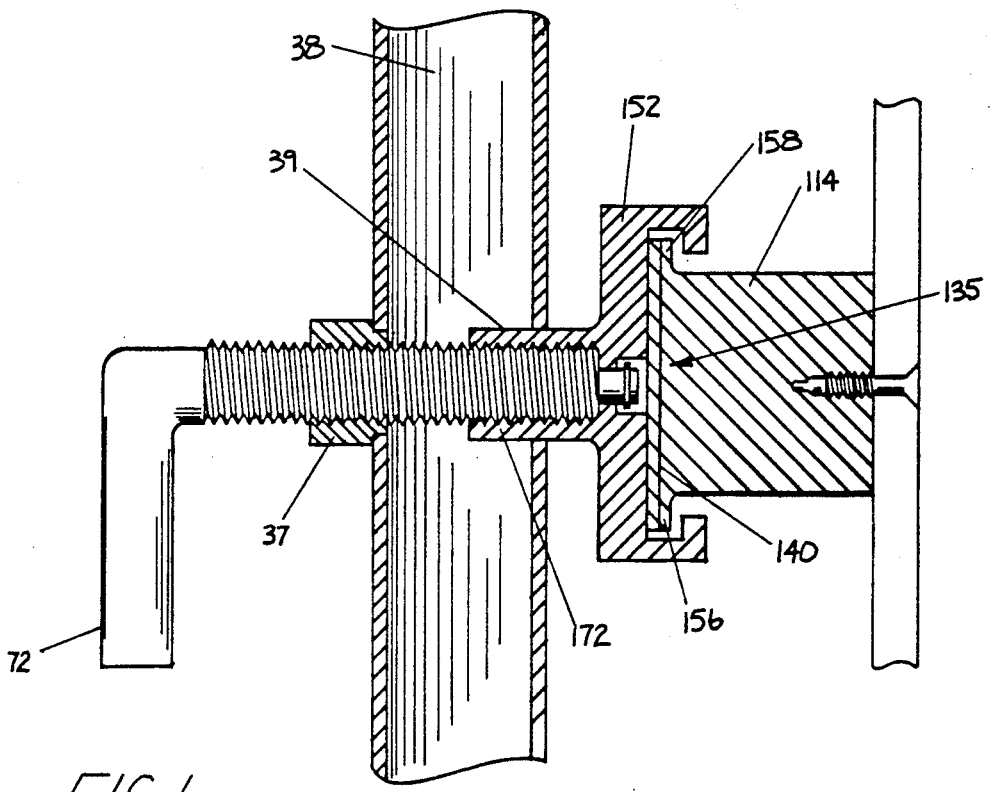
FIG. 6 is a schematic side view illustrating the lower connecting mechanism having adjusting and connecting means for positioning and connecting the forms relative to the beam clamp.

In FIGS. 5 and 6 attached to cross members 112 and 114 116, by any conventional means such as welding, is shown flat, tracks 140, 141, respectively, slightly wider in widest part than the width of the horizontal cross members 112, 114. Although only tracks 140 attached to horizontal cross member 114 is shown, identical tracks 140 are attached to horizontal cross member 116 in the same way and in the same relative position as tracks 140 are attached to horizontal cross member 114. The tracks 141, 140, are attached to the horizontal Cross members 112, 114, and 116 in functional position relative to the connecting mechanisms 80 and 82 as shall be hereafter described.

In operation, as shown in FIG. 3, the panel forms 100 are lifted into the grooves 55 and 56 respectively by human intervention so that the panel forms 100 abut the support pieces 52, 54 and the holder pieces 51, 53 at the lips 57, 58 respectively, and are then slid lengthwise to engage the tracks 141, 140 with the brackets 142, 152 respectively. The lips 57, 58 provide a constraint against which the panel form 100 is firmly pressed by the pressure exerted by the separation of the form panel 100 and the leg members 38, 42 caused by the rod 72 being turned along its threaded axis through the threaded aperture 70 into contact with the connecting means 80. Such constraint acts as a pivoting point against which the form panels 100 may slightly rotate so as to be firmly pressed by the interaction of the remaining rods 72 and connecting mechanisms 82, against the top of a cinder or concrete block wall 15 or a beam pan 180 and thereby firmly position the beam clamp system atop of the wall !5 or against the sides of the beam pan 180.

When using the invention to make a header on an existing wall 15, wood cleats are driven into the existing wall 15 at a distance below the top of the wall. The forms 100 are rested on top of the wood cleats until the forms 100 are clamped against the sides of the wall !5.

End pans 181 positioned between the forms 100 can also be used to define the outer edge of the concrete. These end pans 181 extend from the top of the existing wall 15 o beam pan 180 to a height higher than the desired height of the concrete, and are firmly clamped between forms 100 in accordance with the invention.

FIG. 5 is an expanded cross-section end view of the area around the connecting mechanism 80 as it exists around the elongated leg member 38. Although FIG. 5 is a view of the area around the elongated leg member 38, the area around the leg member 42 is but a mirror image of the view presented in FIG. 5.

In FIG. 5, panel form 100 is shown with the track 141 attached to the horizontal cross member 112 at 134. Because the track 141 is wider than the cross member 112, a portion of the track 141 presents itself downward below the cross member 112 in the form of a lip 136. Supporting and encasing the lip 136 is a grooved bracket 142. The bracket 142 is connected to the rod 72 by inserting the circumferentially reduced end 73 of the rod 72 through a hole 143 in back of and centered along the length of the bracket 142 as shown in FIG. 11. The length of the circumferentially reduced end 73 is such that when the noncircumferentially reduced part of the rod 72 is abutted to the back of the bracket 142 at 144, the circumferentially reduced end 73 extends through hole in the bracket 142 and into a slot 145 cut lengthwise in the bracket 142 to a distance slightly less than the plane 146 of the form-facing side of the bracket 142. A "C" clip 75 is attached to the groove 74 as shown in FIG. 8. By not extending the circumferentially reduced end 73 through the plane 146 of the form facing side of the bracket 142, the rod 72 does not itself come into contact with any part of the form 100. Instead, all inwardly directed forces between the rod 72 and the form 100 are transferred first through the contact at 144 on the back of the bracket 142 of the rod 72 at the point on the rod 72 where the normal circumference of the rod 72 is reduced to the circumferentially reduced end 73. The form side of the bracket 142 comes into physical contact with the track 141 which is attached to the frame 110 of the form 100 thus transferring the inward directed forces from the bracket 142 to the form 100.

The bracket 142 has a catcher 147 which extends inward from the main body of the bracket 142 and ends in an upturned lip 148, thus forming a groove 149. The width of the groove is slightly wider than the width of the track 141 so that the lip 136 of the track 141 rests securely on and is enclosed by the catcher 147. The form 100 is thus supported by the interaction between the catcher 147 and the lip 136.

Attached to the back of the bracket 142 by means such as welding is a sleeve 162 through which the rod 72 is extended. The sleeve 162 guides the rod 72 as it is placed in contact with the bracket 142 at 144. Corresponding in diameter to the diameter of the sleeve is a recess 39 cut into the inside of the elongated leg member 38. This recess 39 receives the sleeve 162 and provides a channel for the movement of the sleeve 162 as the bracket 142 is moved in or out by the turning of the rod 72 as it intermeshes with the nut 37 o the elongated leg member 38.

As can be seen in FIG. 5, the threaded part of the rod 72 is functionally engaged with the inside thread on the nut 37 attached to the elongated leg 38 colineally with the aperture 70 by means such as welding.

FIG. 6 shows an expanded cross section end view of the area around the connecting mechanism 82 as it exists around the elongated leg member 38. Although FIG. 6 is a view of the area around the leg member 38, the area around leg member 42 is but a mirror image of the view presented in FIG. 6. Although FIG. 6 shows the area around the cross member 114, there is functionally no difference between the view presented in FIG. 6 and the area around the cross member 116, the view presented using the cross member 114 merely as an example of the configuration of the area around either of them.

In FIG. 6 is shown in cross section a horizontal cross member 114. Attached to the cross member 114 is the track 140 at 135 so that portions of the track 140 extend beyond the edge of the cross member 114 on both the top and bottom side of the cross member 114. The extension of the track 140 beyond the edge of the cross member 114 creates two lips 156, 158. Supporting on the bottom of lip 156, enclosing the lip 156, extending upward toward lip 158 and enclosing lip 158 is a double-grooved bracket 152 shown in FIG. 10. The holder 152 is connected to a rod 72 in identical fashion and with identical purpose as the holder 142 is connected to rod 72 as described above.

FIG. 10 shows bracket 152 which includes two catchers 157, 167. Catcher 167 is identical in form and function to catcher 147 described above. Catcher 157 is the mirror image of catcher 167 and is placed on the top side of bracket 152.

Also shown attached to bracket 152 in FIG. 10 is a sleeve 172 identical in form and function to sleeve 162 described above and made to cooperate with recesses 39 cut in the elongated leg members 38, 42 in exactly the same manner as sleeve 162 does.

As is also shown in FIG. 6, the threaded part of the rod 72 is functionally engaged with the inside thread on the nut 37 attached to the elongated leg 38 colineally with the aperture 70 by means such as welding.

FIG. 12 shows a perspective view of a "re-bar" hanger, generally labeled 200. From this drawing can be seen two cups 210 formed to support and gravitationally position "re-bar" that is to be surrounded and encased in the liquid concrete. In addition, an inverted cup 212 is formed to facilitate the placement of a third "re-bar". This third "re-bar" is kept from falling by the twisting or tying of small wires or twist ties around the "rebar" and the frame of the hanger 200 at a point near 212, as is well known in the art. Above the inverted cup 212 is a neck 216, ending in a hook 220 rotated at 90 degrees to the normal position of a hook on a clothes hanger.

The hanger 200 is slid over the three pieces of re-bar until the hanger is in the appropriate lateral position. Two "bars" are then placed in the cups 210 while the third is tied up to the hanger 200 at the inverted cup 212. The entire hanger 200 is then lifted into the unobstructed space 48. The hanger 200 with the "re-bar" is suspended by placing the hook 220 over the transverse member 31.

FIG. 13 shows another embodiment of the "re-bar" hanger, generally labeled 250, which allows the placement of four pieces of "re-bar". The cups 260 correspond in function to the cups 210 on the three re-bar hanger described above. In addition, there are two inverted cups 262 with identical function to the inverted cups 212. The neck 266 and hook 270 are identical in form and function to the corresponding pieces on hanger 200, as is the operation of this hanger 250 with the hanger 200.

The hangers 200, 250 are made of a heavy gage metal bar that is bent or formed into the shape as herein described and shown.

Figure 14:
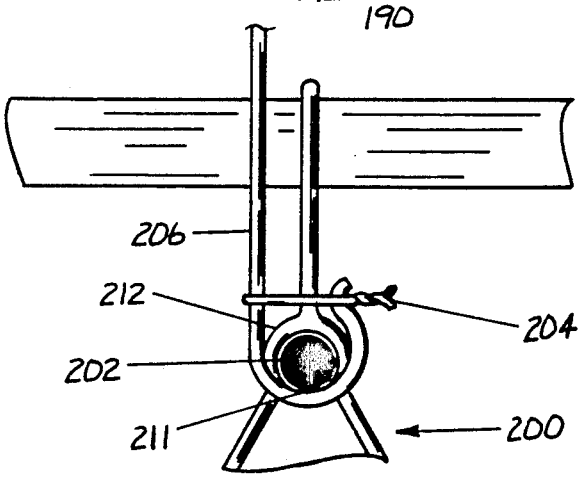
FIG. 14 shows the shepherd crook-shaped truss strap attached to a piece of "re-bar" positioned in the inverted cup of FIG. 11.

FIG. 14 shows a piece of "re-bar" 202 set in position in the inverted cup 212 of the hanger 200. Also shown is a shepherd crook-shaped truss strap 206 extending upward through the top of the beam clamp unit 10 and wrapped around the "re-bar" 202 and bound to the "re-bar" 202 and hanger 200 by twist tie 204 which holds both the truss strap 206 and the "re-bar" 202 to the hanger 200. The twist tie 204 is of the kind common in the industry. The shepherd crook-shaped truss strap 206 is made of a long, thin, flat piece of metal with holes drilled in it midway from side to side at various positions down the length of the truss strap 206. The holes are to provide places through which nails can be driven to secure the truss strap 206, and thereby the concrete beam or wall header, to a roof truss. The truss strap 206 is curved at one end to provide a cradle 211 to securely hold a piece of "re-bar". A short distance above the highest point where a piece of "re-bar" would rest in the cradle, 211, the metal of the truss strap 206 is bent 90 degrees so that the flat part of the truss strap 206 is at a right angle to the "re-bar" 202 resting in the cradle 211.

Figure 4:
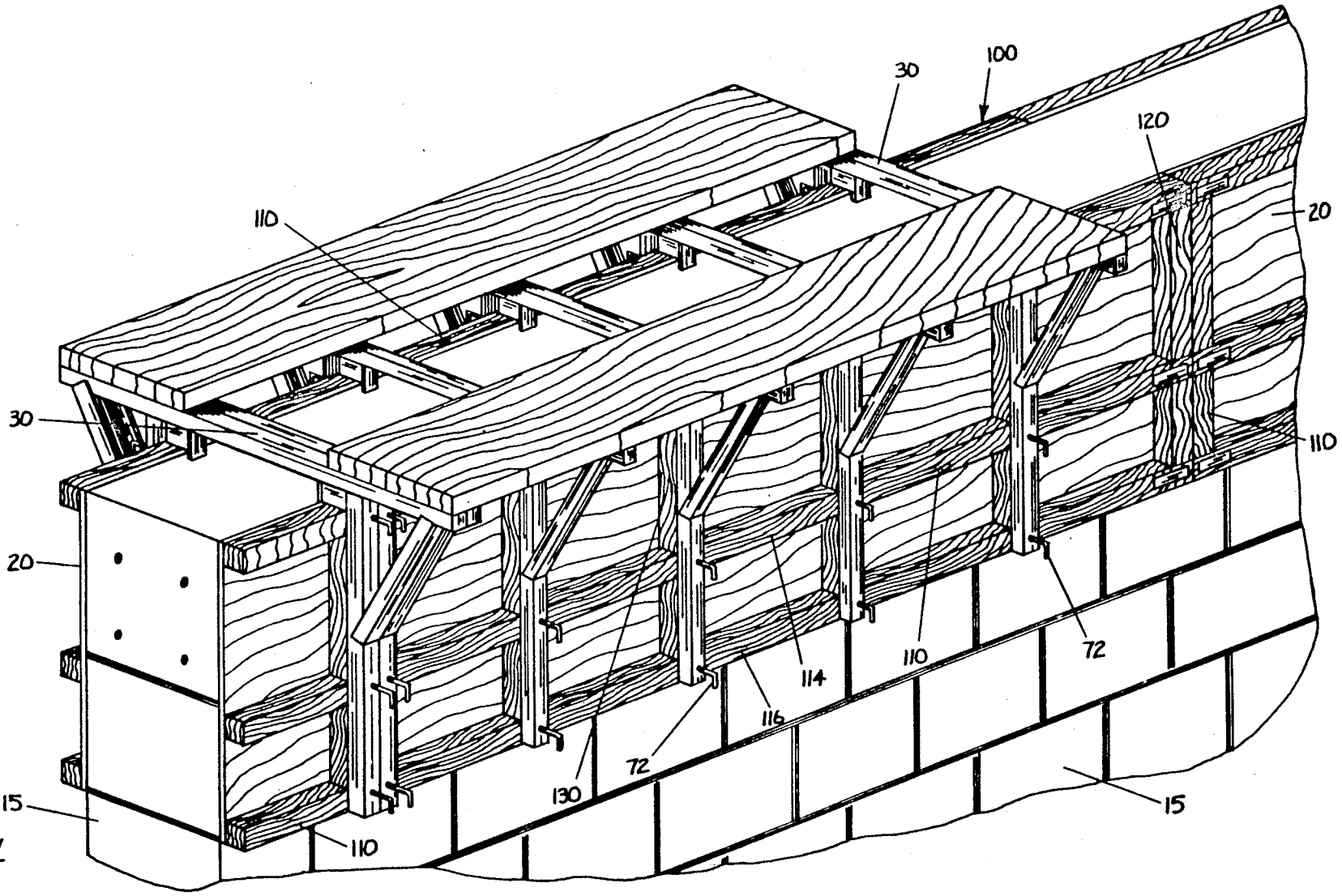
FIG. 4 is a perspective view of the invention showing the relative positioning of the beam clamps, the forms, the adjustable means for connecting the forms to the beam clamps, and the scaffolding shown in cut-away.

Attached to the top surface 32 of the transverse member 31 are two scaffold pieces 160 as shown in FIG. 3. The scaffold pieces 160 are typically made of a plurality of boards such as 2" x 10" boards which are attached to the transverse member 31 by a bolt 165 extending through the scaffold piece 160 and through the transverse member 31 a sufficient distance for a nut 164 to be securely, threadably, attached. As shown in FIG. 4, the scaffold pieces 160 as attached to the transverse members 31 provide rigidity to the beam clamp system and hold each of the beam clamp units 10 in a precisely spaced position, relative to each other.

Also attached near each of the ends 36, 46 of the transverse member 31 are a pair of support arms 170 that extend from the transverse member 31 at an angle to each of the leg members 38, 42 respectively where the support arms 170 are attached to the leg members 38, 42. These support arms 170 are each attached to the transverse member 31 and the leg members 38, 42 by any conventional means such as welding, one support arm 170 on each side of both the transverse member 31 and the leg members 38, 42. The support arms 170 are best made of a rigid material such as strap steel to provide support for the extended arms of the transverse member 31 as well as aiding in the preventing of the outward spreading of the leg members 38, 42 by hydraulic pressure from the liquid concrete. This support is accomplished by directing either downward force from the transverse member 31 or outward force from the leg members 38, 42, to the leg members 38, 42 or the transverse member 31, respectively.

The entire apparatus is shown in FIG. 4. Here, the beam clamp unit 10 is in place with the beam clamp 30 surrounding, connected to, and engaging forms 100 clamped around an existing wall 15. Also shown are the scaffold pieces 160 in place to provide a safe standing place and added rigidity for the apparatus, as well as the top of the shepherd crook-shaped truss strap 206 as it protrudes through the concrete contained between the forms 100.

As can be seen from this view, concrete beam or header of various lengths can be made by using the appropriate length of form 100 or by using several forms placed end to end to make a concrete beam or header of a length greater than is practical with single pairs of forms 100. In the case where several forms 100 are placed end to end, rigidity can be given the apparatus at the point where the forms 100 are placed end to end by causing the scaffolding pieces 160 to extend over the end to end point and be rigidly connected to beam clamps 30 on either side of the end to end point. In this manner, a beam clamp unit 10 of great length can easily be assembled.

Figure 15:
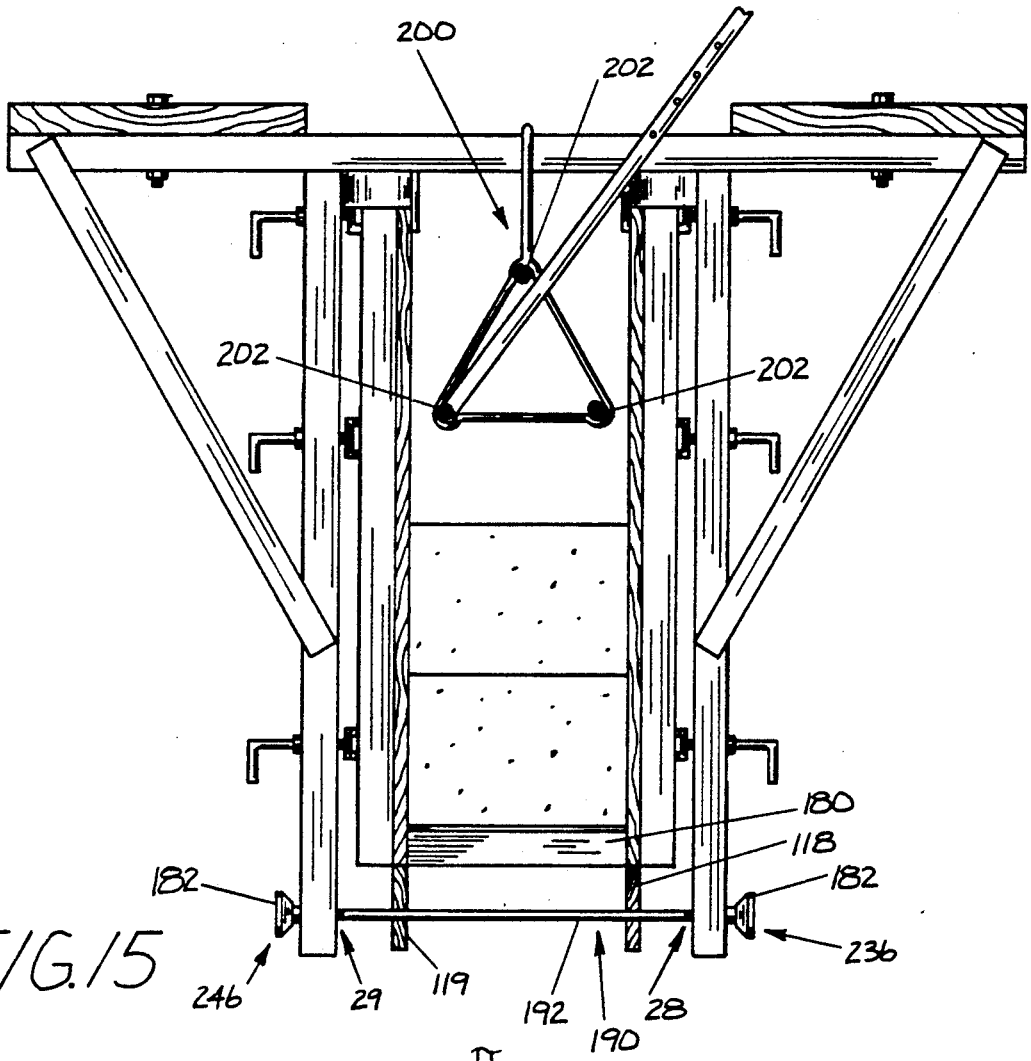
FIG. 15 shows an embodiment of the apparatus shown to make a concrete beam and also shows the three "re-bar" hanger in position as well as showing the shepherd crook-shaped truss strap attached to the hanger.

As was noted above, FIG. 4 shows the apparatus 10 in embodiment for use on an existing wall 15. The invention can also be used to make a concrete beam. This is best shown in FIG. 15. When the invention is used in this embodiment, the beam pan 180 is clamped between the forms 100 in the same way wall 15 is clamped between the forms 100 in the previously described embodiment.

In FIG. 15 is shown the beam clamp unit 10, shown clamped around a beam pan 180. In this embodiment, a tie rod clamp 190 is added to the beam clamp unit 10 made of a heavy gage metal tie rod 192, threaded on both ends, 236, 246. The tie rod 192 is positioned perpendicular to each of the forms 100 and extending under the beam pan 180, through the forms 100 and through the elongated leg members 38, 42 at 28, 29 so as to present both its ends beyond the outside edge of the leg members 38, 42.

Screwed on to the extended threaded ends of the tie rod 192 are knobs 182 having a threaded inner bore that functionally intermesh with the threaded ends of the tie rod 236, 246. These knobs 182 are turned so as to come into physical contact with the outside of the elongated leg members 38, 42 and push these leg members 38, 42 toward the unobstructed space 48. This inward pushing motion is transferred to the forms 100 by the connecting mechanisms 80 and 82 and serve to increase the clamping ability of the apparatus on the beam pan 180.

Also shown in FIG. 15 is a three "re-bar" hanger 200 in place with three pieces of "re-bar" 202 in place to be encased in the liquid concrete of the concrete beam. A shepherd crook-shaped truss strap 206 is also shown wrapped around one of the pieces of "re-bar" and shown extending upward through the top of the beam clamp 10 so as to be functionally positioned to attach to a roof truss. In this position, the truss strap 206 will have a significant part of its length encased in the concrete to be poured between the forms 100 as well as being secured at one end to the "re-bar" by wrapping around the "re-bar" and secured with a twist tie.

Depending on the configuration of the wall header or concrete beam to be built, end pans 181 may be used to provide an end stop to contain the liquid concrete poured between the forms 100. The end pans 181 are placed between the forms 100 at the end of the area to be filled with liquid concrete. As the forms 100 are clamped together by the beam clamp system, the end pans 181 are also pressed between the forms 100, thus holding them firmly in position.

The materials forming the various members of the "pi"-shaped member 10 and the frame 110 are preferably fabricated of extruded aluminum or steel tubing or channels and sheet 140 is preferably fabricated of plywood, plywood with a metal facing, or fiberglass.

The metal members may be secured to each other by welding, nuts and bolts, or other suitable adhesive compositions.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. An apparatus for containing liquid concrete until it hardens comprising:

(a) a pair of spaced apart forms disposed to contain said liquid concrete therebetween and establish the dimensions of the concrete upon hardening;

(b) clamp means for maintaining the forms in said spaced apart relation; and (c) means mounted on the clamp means for applying an inward force against each of the forms to enable the apparatus to be pressed against a structure to define the apparatus to be pressed against a structure to define a confined space; and (d) means mounted on the force applying means for vertically retaining the forms relative to the clamp means while permitting relative horizontal movement between the forms and the clamp means.

2. An apparatus for containing liquid concrete until it hardens as claimed in claim 1 wherein said clamp means (a) a transverse member having a top and bottom side and further having a left and right free end;

(b) a first elongated leg member attached to said bottom side of said transverse member toward said right free end of said transverse member, having a left and right side;

(c) a second elongated leg member attached to said bottom side of said transverse member toward said left free end of said transverse member, and having a left and right side;

(d) a first support piece abutted to and rigidly secured to said first elongated leg member on said left side of said elongated leg member and to said bottom side of said transverse member;

(e) a second support piece abutted to and rigidly secured to said second elongated leg member on said right side of said elongated leg member and to said bottom side of said transverse member;

(f) a first holder piece extending downward from said bottom side of said transverse member and rigidly secured to said bottom side of said transverse member and to said first support piece;

(g) a second holder piece extending downward from said bottom side of said transverse member and rigidly secured to said bottom side of said transverse member and to said second support piece;

(h) a plurality of rods;

(i) a plurality of apertures on each of said first and second leg members, extending through said leg members from left to right and further having means to adjustably attach said rods to said first and second elongated leg members through said apertures so as to engage and apply said inward force to said forms.

3. An apparatus for containing liquid concrete until it hardens, as described in claim 2 whereby said rods further each comprise a partially threaded shaft.

4. An apparatus for containing liquid concrete until it hardens, as claimed in claim 3 wherein said means to adjustably attach said rods to said first and second elongated leg members comprises threads internal to said apertures.

5. An apparatus for containing liquid concrete until it hardens, as claimed in claim 4, wherein said threads of each aperture are provided by the internal threads of a nut rigidly attached to the respective first and second elongated leg members.

6. An apparatus for containing liquid concrete until it hardens, as described in claim 2 whereby said rods further each comprise a circumferentially reduced end engaging said forms.

7. An apparatus for containing liquid concrete until it hardens, as described in claim 6 whereby said rods further each comprise:

(a) a groove cut circumferentially around said circumferentially reduced end;

(b) a "C" clip set into said groove.

8. An apparatus for containing liquid concrete until it hardens, as described in claim 2 wherein said rods further each comprise a handle attached to said rod.

9. An apparatus for containing liquid concrete until it hardens, as described in claim 8 wherein said handle is formed by bending said rod to form a substantially right angle.

10. An apparatus for containing liquid concrete until it hardens, as claimed in claim 2 wherein said forms each comprise:

(a) a plurality of horizontal pieces;

(b) a first end piece vertically positioned and rigidly attached to an end of each of said horizontal pieces;

(c) a second end piece vertically positioned and rigidly attached to each of said horizontal pieces on the opposite end of said horizontal pieces that said first end piece is attached;

(d) a sheet, attached to the frame created by said horizontal pieces, said first end piece, and said second end piece; and (e) a plurality of substantially flat tracks rigidly attached to said horizontal pieces on the side of said frame opposite to said sheet and extending vertically beyond the vertical width of said horizontal pieces so as to form a lip.

11. An apparatus for containing liquid concrete until it hardens, as claimed in claim 10 wherein said vertical retaining means comprises:

(a) a plurality of brackets having means to slidably engage and enclose said tracks; and (b) means to attach one of said brackets to each of said rods.

12. An apparatus for containing liquid concrete until it hardens, as claimed in claim 11 wherein said brackets further each comprise:

(a) a vertical rigid back parallel to said tracks; and, (b) means extending inwardly from said back of said bracket, ending in a lip projecting vertically and spaced inwardly from the vertical back thereby forming a groove slidably receiving the lip of said track.

13. An apparatus for containing liquid concrete until it hardens, as claimed in claim 11 wherein each of said rods further comprises a circumferentially reduced end engaging said forms and said brackets further each comprise:

(a) an aperture through each of said brackets from the side of said bracket closest to said elongated leg member to the side of said bracket closest to said form, through which said circumferentially reduced end of said rod extends; and;

(b) a horizontal slot wider than the diameter of said aperture in said bracket and extending along the side of said bracket closest to said form of a size to receive said "C" clip set into said groove on said circumferentially reduced end of said rods.

14. An apparatus for containing liquid concrete until it hardens, as claimed in claim 13 wherein each of said bracket further comprises a sleeve, rigidly attached to the side of said bracket closest to said elongated leg member and being colineal to said aperture in said bracket, further having a sufficient inside diameter to allow said rod to pass through.

15. An apparatus for containing liquid concrete until it hardens, as described in claim 1 wherein said clamp means comprises:

(a) a transverse member having a top and bottom side and further having a left and right free end;

(b) a first elongated leg member attached to said bottom side of said transverse member toward said right free end of said transverse member, having a left and right side;

(c) a second elongated leg member attached to said bottom side of said transverse member toward said left free end of said transverse member, and having a left and right side;

(d) a first support piece abutted to and rigidly secured to said first elongated leg member on said left side of said elongated leg member and to said bottom side of said transverse member;

(e) a second support piece abutted to and rigidly secured to said second elongated leg member on said right side of said elongated leg member and to said bottom side of said transverse member;

(f) a first holder piece extending downward from said bottom side of said transverse member and rigidly secured to said bottom side of said transverse member and to said first support piece;

(g) a second holder piece extending downward from said bottom side of said transverse member and rigidly secured to said bottom side of said transverse member and to said second support piece;

(h) each of said forms comprise:

(i) a plurality or horizontal pieces;

(ii) a first end piece vertically positioned and rigidly attached to an end of each of said horizontal pieces;

(iii) a second end piece vertically positioned and rigidly attached to each of said horizontal pieces on the opposite end of said horizontal pieces that said first end piece is attached to;

(iv) a sheet, attached to the frame created by said horizontal pieces, said first end piece, and said second end piece; and (v) a plurality of substantially flat tracks rigidly attached to said horizontal pieces on the side of said frame opposite to said sheet and extending vertically beyond the vertical width of said horizontal pieces so as to form a lip;

(i) a plurality of rods wherein said rods further comprise:

(i) a partially threaded shaft;

(ii) a circumferentially reduced end;

(iii) a groove cut circumferentially around said circumferentially reduced end; and (iv) a "C" clip set into said groove;

(j) a plurality of apertures on each of said first and second leg members, extending through said leg members from left to right and further being adapted to adjustably receive said rods through said apertures so as to engage and apply said force to said forms;

(k) said vertical retaining means comprising a plurality of brackets positioned so as to enclose and engage said tracks; said brackets having:

(i) a vertical rigid back parallel to said tracks;

(ii) means for engaging and enclosing said tracks extending inwardly from said back of said bracket, ending in a lip projecting vertically and spaced inwardly from the vertical back thereby forming a groove slidably receiving the lip of said track;

(iii) an aperture through each of said brackets from the side of said bracket closest to said elongated leg member to the side of said bracket closest to said form through which said circumferentially reduced end of said rods extend; and, (iv) a horizontal slot wider than the diameter of said aperture in said bracket and extending along the side of said bracket closest to said form of a size to receive said "C" clip set into said groove on said circumferentially reduced end of said rod;

whereby each of said rods are engaged with each of said apertures on each of said first and second leg members, and wherein said circumferentially reduced end of each of said rods is extended through said aperture in each of said brackets so that said groove in said rod is positioned in said slot and said "C" clip is set into position in said groove.

16. An apparatus for containing liquid concrete until it hardens, as claimed in claim 1 further comprising:

(a) hanger means to simultaneously position and support re-bar between the forms;

(b) means for hanging said hanger means and said re-bar on said clamp means.

17. An apparatus for containing liquid concrete until it hardens, as claimed in claim 16, wherein said hanger means to simultaneously position and support re-bar between said forms comprises:

(a) at least one cup shaped receptacle to gravitationally support and position re-bar;

(b) a neck connected to said receptacle;

(c) a hook connected to said neck and turned at right angles to the receptacle.

18. An apparatus for containing liquid concrete until it hardens, as claimed in claim 17 further comprising:

at least one inverted cup shaped receptacle to support and position re-bar; and means to connect said cup shaped receptacle and said inverted cup shaped receptacle.

19. An apparatus for containing liquid concrete until it hardens, as claimed in claim 17 further comprising an arcuate shaped truss strap which is wrapped around a piece of "re-bar" positioned and supported within said forms by said hanger and extending upward from said apparatus.

20. An apparatus for containing liquid concrete until it hardens as claimed in claim 1 further comprising a beam pan located so as to define the lower boundary of the liquid concrete and positioned between said forms so as to be clamped therebetween.

21. An apparatus for containing liquid concrete until it hardens as claimed in claim 1 further comprising an end pan located at one end of said forms so as to define the outer boundary of the liquid concrete and positioned between said forms so as to be clamped therebetween.

* * * * *